US005619830A

United States Patent [19]

Osborn

[11] Patent Number: 5,619,830

[45] Date of Patent: Apr. 15, 1997

[54] VARIABLY ASSEMBLABLE FIGURATIVE TILES FOR GAMES, PUZZLES, AND FOR COVERING SURFACES

[76] Inventor: John A. L. Osborn, 250 Donegal Way, Martinez, Calif. 94553

[21] Appl. No.: 403,079

[22] Filed: Mar. 13, 1995

[51] Int. Cl.[6] ..... B44F 3/00; B44C 1/25

[52] U.S. Cl. ..... 52/311.2; 52/390; 273/157 R; D21/105; D25/138

[58] Field of Search ..... 52/390, 311.2, 52/311.1, 608; D21/104, 105, 108; D25/138; 273/292, 293, 294, 153 R, 156, 157 R, 160

[56] References Cited

U.S. PATENT DOCUMENTS

| | | | |
|---|---|---|---|
| 4,133,152 | 1/1979 | Penrose . | |
| 4,217,740 | 8/1980 | Assanti . | |
| 5,314,183 | 5/1994 | Schoen | 273/294 X |
| 5,481,841 | 1/1996 | Osborn | 273/157 R X |
| 5,520,388 | 5/1996 | Osborn | 273/157 R |

OTHER PUBLICATIONS

Locher, *M. C. Escher: His Life and Complete Graphic Work*, 1981, p. 304.

Escher, *Escher on Escher: Exploring the Infinite*, 1986, pp. 90–115.

Gardner, *Mathematical Games: Extraordinary Nonperiodic Tiling that Enriches the Theory of Tiles, Scientific American*, Jan. 1977, pp. 81, 110–112, 115–121.

U.S. patent application No. 08/317,899—filing date Oct. 4, 1994—Title: "Variably Assemblable Figurative Tile Set for Covering Surfaces".

J.A.L. Osborn, "Amphography, The Art of Figurative Tiling", in *Leonardo*, vol. 26 #4, pp. 289–291, 1993.

*Primary Examiner*—Carl D. Friedman
*Assistant Examiner*—Laura A. Saladino
*Attorney, Agent, or Firm*—Harris Zimmerman

[57] ABSTRACT

Families of rhombus-based two-zoomorph variably assemblable tile sets wherein a single amphographic line delineates different parts of one zoomorph and different parts of a second and different zoomorph as well, and may similarly delineate further fatter or skinnier zoomorphs. All or some of these may, in conjunction with one another, tile the plane in an infinite number of different and interesting ways. These tiles and tilings and patches of tiles may be used in puzzles, in games, for teaching certain aspects of geometry, or for the decoration of fabrics or other surfaces.

6 Claims, 7 Drawing Sheets

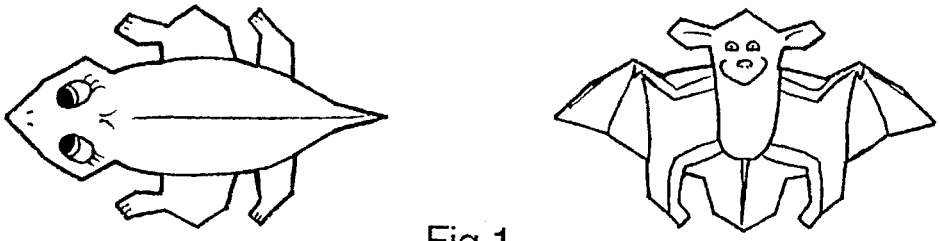
Fig. 1
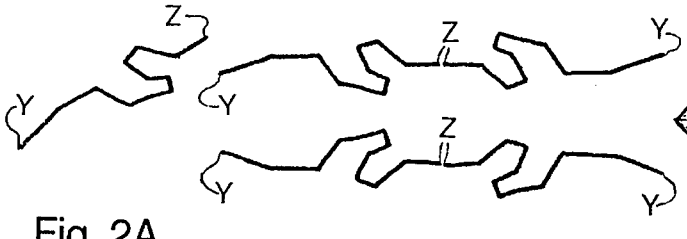
Fig. 2A
Fig. 2B
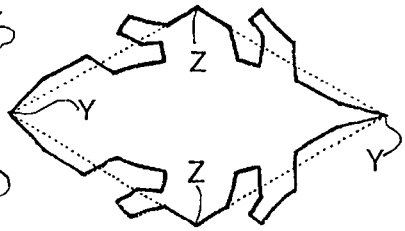
Fig. 2C
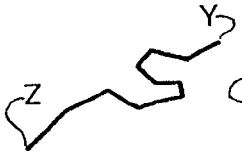
Fig. 3A
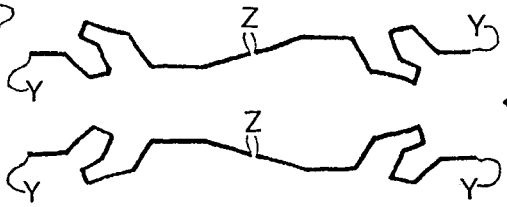
Fig. 3B
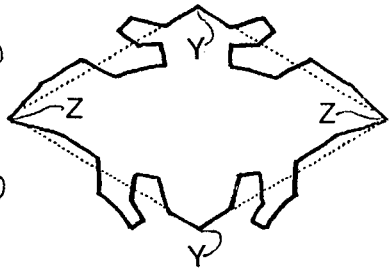
Fig. 3C
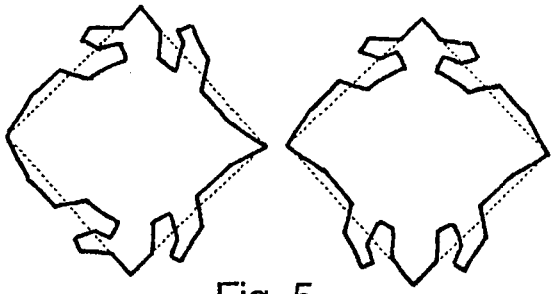
Fig. 5
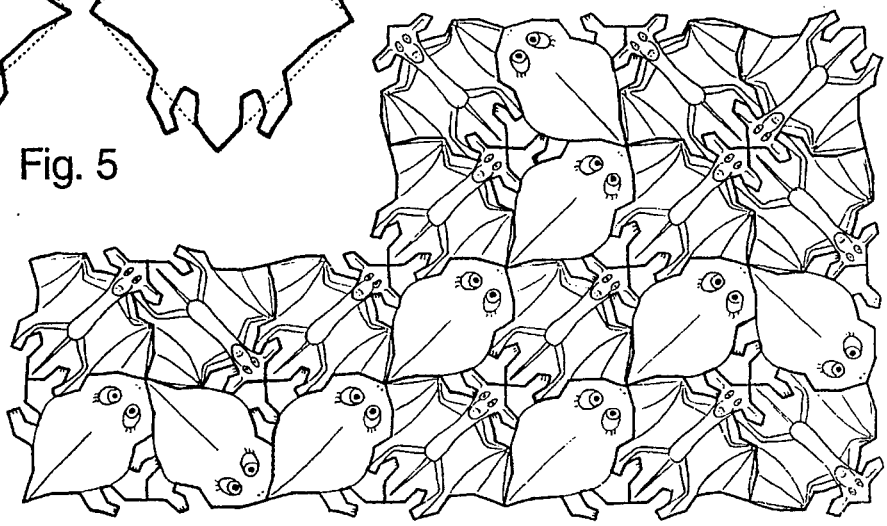
Fig. 6

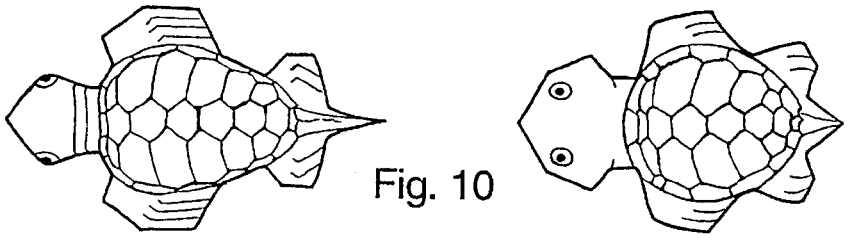
Fig. 10
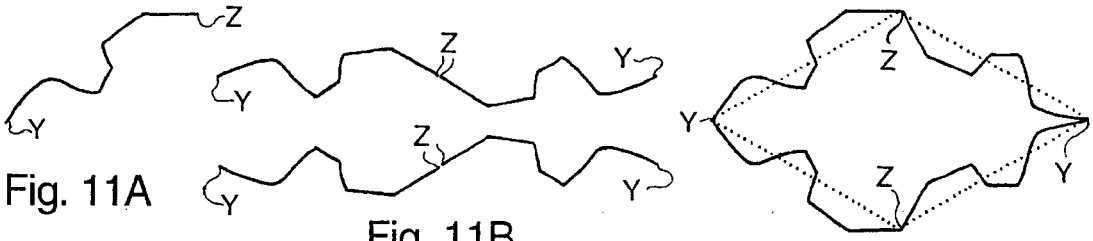
Fig. 11A
Fig. 11B
Fig. 11C
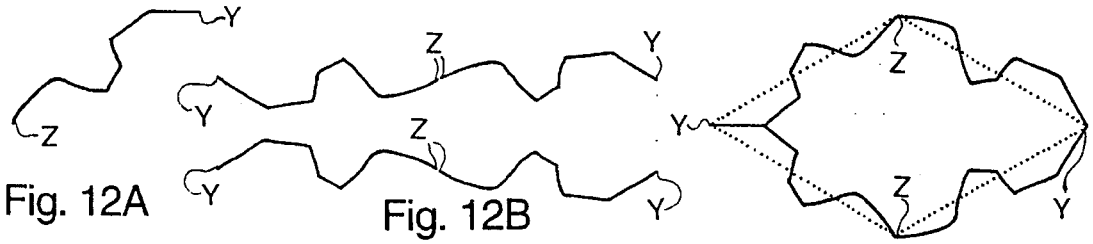
Fig. 12A
Fig. 12B
Fig. 12C
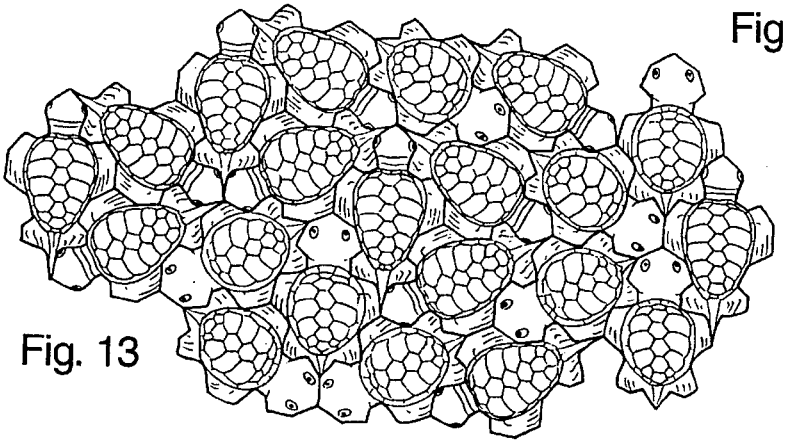
Fig. 13
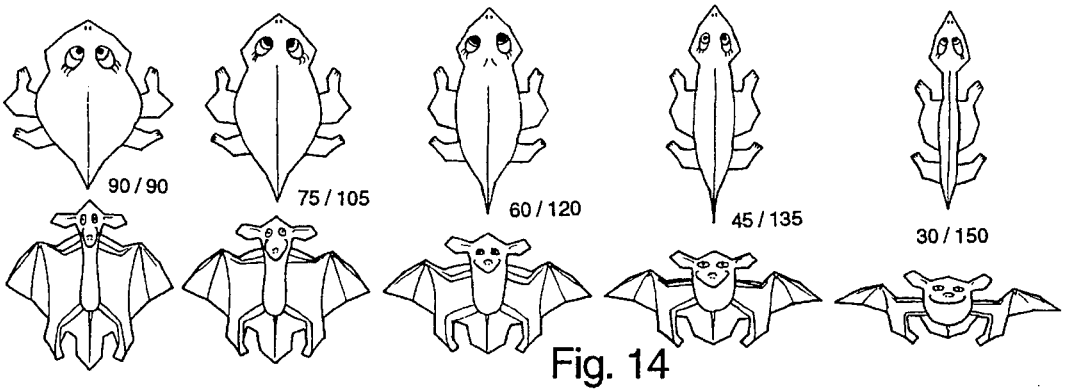
Fig. 14

VARIABLY ASSEMBLABLE FIGURATIVE TILES FOR GAMES, PUZZLES, AND FOR COVERING SURFACES

BACKGROUND

1. Field of the Invention

This invention relates to the field of tiles and tilings. The field includes the familiar floor and kitchen-counter top tiles and tilings of commerce and their like, but also extends to the sometimes more abstract areas of art, design, and mathematics.

Some Definitions

I have adapted a few of the notions and definitions of the mathematics of tiles and tilings as follows. A tile is a two-dimensional closed shape which fits together edge-to-edge with other different or similar two-dimensional shapes, as do jig-saw puzzle pieces or bricks, to cover a flat surface of indefinite extent. Such a covering is called a tiling if it has no gap between tiles nor any overlap of one tile on another. Adding thickness to a two dimensional tile will make it a three dimensional object which is also called a tile. A tile or a set of tiles is said to tile the plane if indefinitely large numbers of duplicates of the tile or of the members of the set of tiles can fit together without gap or lap in a tiling. The term the plane refers to the flat indefinitely extensive plane of Euclidian geometry. As a verb, tile means to form a tiling.

A figurative tile is one whose shape is the recognizable outline, or figure, of a person or an animal. A figurative tiling is a tiling composed of such figurative tiles.

Figurative and zoomorphic are very much the same. Zoomorphic includes anthropomorphic. A family of zoomorphic tiles comprises all and only tiles whose four edges are formed by a particular amphographic line and its mirror image.

A variably assemblable tiling is one whose tiles function so as to fit together or to interlock with one another in a variety of different ways, allowing a plurality of different tilings to be made. Perhaps the simplest tile to form such a plurality is the common brick with its many different arrangements and patternings in walls and pavings. Sets of curved sided tiles that are variably assemblable are somewhat more difficult to design, as may be seen in U.S. Pat. No. 4,217,740 of Aug. 19, 1980 to Assanti.

An amphographic line is a line each side of which draws a different part of the outline of the same figure, and does so between the vertices of an ancestral straight-line geometric figure of a sort chosen so that the completed figurative outline will, when replicated, tile the plane. It can be said, then, that an amphographic line such as is used in single-figure periodic tilings is a line that differs from ordinary lines in doing double the duty of the usual outline. The invention described herein allows an effective redoubling of the number of things drawn by certain carefully devised amphographic lines so that they become lines that do quadruple duty. Each side of such a line depicts different parts of two different figures.

An ancestral rhombus can be thought of as an underlying, invisible, geometric determiner of vertex locations. Dotted lines are used herein to show ancestral rhombuses.

Expressions such as 60/120 or 45/135 describe rhombuses having internal or vertex angles as indicated, eg.: 60 degrees and 120 degrees, or 45 degrees and 135 degrees.

By zoomorphic outline of a different sort is meant not merely a fatter or a skinnier version, (based on a fatter or skinnier ancestral rhombus), of a given zoomorphic outline, but rather an outline of a different zoological character, in the way that a bat is different from a lizard, or, (as seen in the Mother and Baby Sea Turtles shown in FIGS. 10 and 12), in the way a juvenile's shape is different from that of an adult.

2. Prior Art

U.S. Pat. No. 4,133,152 of Jan. 9, 1979 to Penrose shows a figurative and variably assemblable set of two tiles that has since become known as "Penrose's chickens". This is the only known variably assemblable figurative tile set that is not the work of the present inventor, John A. L. Osborn.

OBJECTS AND ADVANTAGES

It is an object of the invention to provide puzzle pieces of many sorts capable of fitting together and interlocking with one-another, and from which one can choose a variety of pieces for accomplishing various tiling tasks of puzzle-like sorts.

It is another object of the invention to provide zoomorphic tiles of different sorts, which together can tile the plane in an infinite number of different ways, and which allow impromptu variations in the patterns of the tilings they form while those tilings are being assembled.

It is an object of the invention to provide a variety of families of zoomorphic tiles. Some of these families will provide a diversity of tile shapes which are capable, either alone or in varied combinations, of tiling the plane in many different ways, and by doing so will provide aesthetically pleasing, visually complex, and intellectually interesting tilings or patches of tiles.

It is an object of the invention to provide tiles and patterns of tilings which can be used in all the many ways that tiles are used decoratively, such as to decorate fabrics, architectural surfaces, and pavings.

BRIEF DESCRIPTION OF THE DRAWINGS

FIG. 1 shows the basic 60/120-based Lizard/Bat set.

FIGS. 2A, 2B, and 2C show the amphographic line of the Lizard/Bat family and its use to form a lizard.

FIGS. 3A, 3B, and 3C show the relabeled Lizard/Bat line and its use to form a bat.

FIG. 5 shows the basic square-based Lizard/Bat set in outline only.

FIG. 6 shows a patch of a tiling by the 90/90, or square-based, Lizard/Bat set.

FIG. 10 shows the 60/120-derived Mother and Baby Sea Turtle set.

FIGS. 11A, 11B, and 11C show the derivation of a Sea Turtle from a 60/120 rhombus.

FIGS. 12A, 12B, and 12C show the derivation of a Baby Sea Turtle from a 60/120 rhombus.

FIG. 13 shows a patch of Mother and Baby Sea Turtles.

FIG. 14 shows the preferred embodiment: five 2-member sets of the Lizard/Bat family.

SUMMARY OF THE INVENTION

Figure 4:
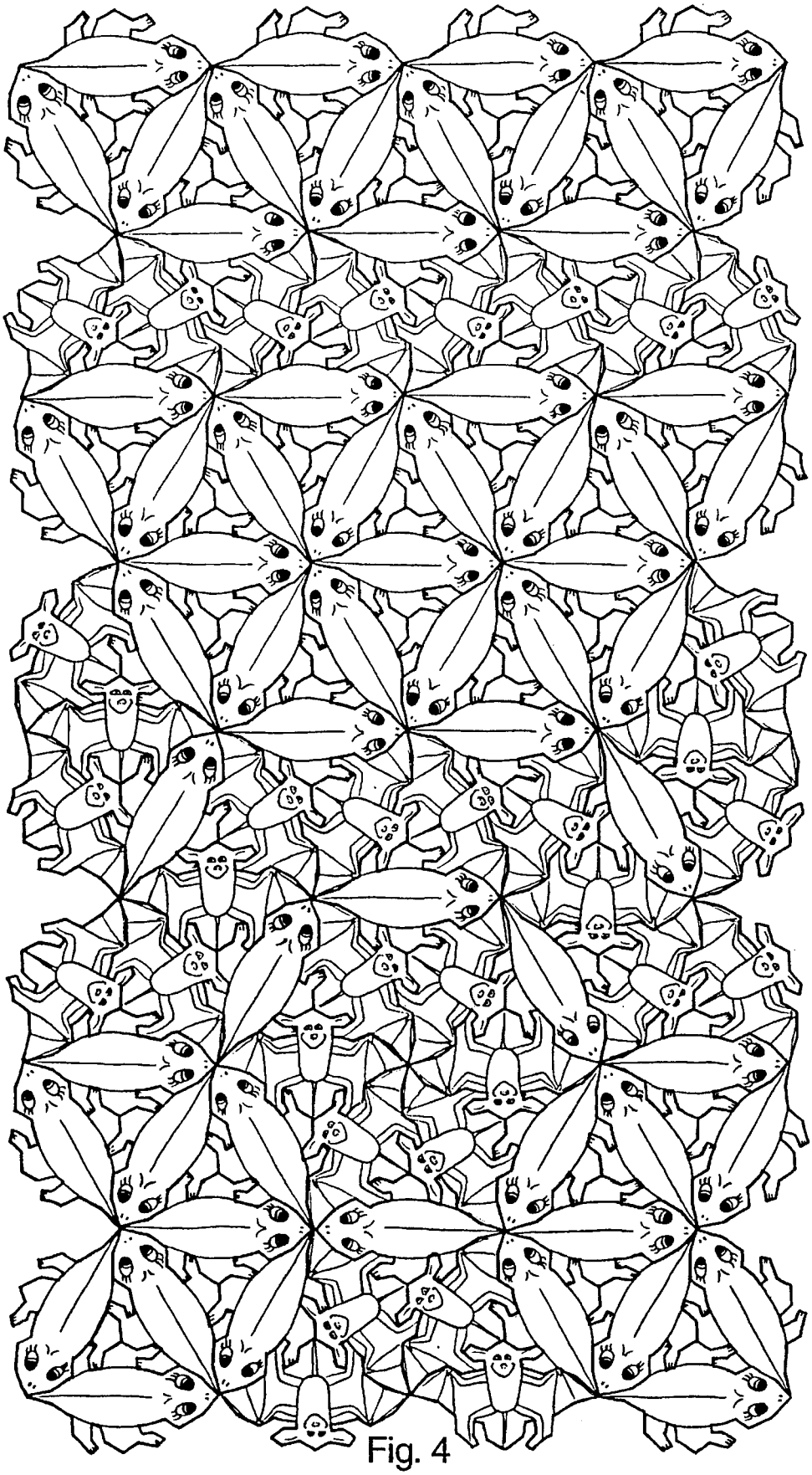
FIG. 4 shows a patch of a tiling by the 60/120-based Lizards and Bats.

My invention comprises tiles resembling different animals which are grouped together into particular families by virtue of being delineated by repetitions of lines unique to and characteristic of those particular families. Each characteristic line, (known as an amphographic line), which functions in this way gives rise to two different and usually very distinct sorts of animal shapes. These animal shapes, or zoomorphs, perhaps in a variety of fatter and skinnier versions, also uniquely characterize each family. The creation of the amphographic lines themselves is a matter of art, judgment, and/or prolonged experiment, and is a process for which no rules or procedures can be given. In most cases, how it is done is a matter which is not accessible even to my own very interested conscious mind. All the tiles of my invention are derived from rhombuses, and retain some of those ancestral rhombuses' ability to form tilings. Sets of two different zoomorphic tiles derived from 60/120 rhombuses, or from squares, and being of the same family, will tile the plane in an infinite number of different ways. So will certain multi-member sets derived from judiciously chosen ancestral rhombuses. As one assembles a tiling, the patterns that are created are often amenable to impromptu variation in ways that can make assembling a tiling a pleasant activity. Many families of tiles are possible, though only four are extensively described herein: Lizard/Bat, Lizard/Pterodactyl, Arachnoid/Insectoid, and Mother and Baby Sea Turtle. Most families can be extended beyond the 60/120, 90/90, or other basic sets to fatter and/or skinnier versions of the two different family zoomorphs. Some of these extended families, if ancestral rhombuses have been properly chosen, will conjoin to tile the plane in particularly complex, variable, and interesting ways.

DESCRIPTIONS OF EMBODIMENTS AND THEIR OPERATION

A first basic embodiment: the 60/120 set of the Lizard/Bat family (A basic embodiment is one which will tile the plane in an infinite number of different ways using replicas of only one two-member set of zoomorphic tiles.)

FIG. 1 shows a 2-member set of figurative tiles in which one tile has a lizard-like outline and the other tile has a bat-like outline. They are shown with internal drawing devised to enhance the zoomorphic characters of the respective outlines. The outline of each figure is formed by two copies of a single artistically devised curved, recurved, and asymmetrical amphographic line and two copies of that line's mirror image.

FIG. 2 A shows the amphographic line used to form the outlines in FIG. 1. The ends of the line have been designated end Y and end Z.

FIG. 2B shows two copies of the amphographic line shown in FIG. 2A attached to one another at their Z ends, and below these, two copies of mirror images of the same amphographic line also attached at their Z ends.

FIG. 2C shows, as a dotted line, a 60/120 degree ancestral rhombus and four identical amphographic lines Y–Z replacing the four sides of the rhombus, their relative orientation and disposition being most easily and systematically achieved by rotating any initial line Y–Z around Z to form an adjacent side, and then reflecting the two adjacent sides thus formed as a unit across the rhombus to replace the other two straight sides of the ancestral rhombus, thus forming a lizard-like outline.

FIG. 3A shows an amphographic line congruent with that in FIG. 2A, but with the ends labeled in the opposite manner.

FIG. 3B shows two copies of the amphographic line shown in FIG. 3A, attached to one another at their Z ends, and below these, two copies of mirror images of the same line also attached at their Z ends.

FIG. 3C shows, as a dotted line, a 60/120 ancestral rhombus and four identical amphographic lines Y–Z replacing the four sides of the rhombus, their relative orientation and disposition being perhaps best achieved by rotating any initial line Y–Z around Z to form an adjacent side, and then reflecting the two adjacent sides thus formed as a unit across the rhombus to replace the two remaining straight sides of the ancestral rhombus, thus forming a second, and different, outline: one having a bat-like shape.

Operation of the 60/120 set of the Lizard/Bat family

When the ancestral rhombus is a 60/120 degree rhombus, as is the case for the zoomorphs shown in FIG. 1 and derived in FIGS. 2 and 3 inclusive, the two-member set so formed is a fully functioning embodiment of the invention, and will tile the plane in an infinite number of different and interesting ways. The lizard-like member of this set will tile the plane with only replicas of itself in a non-variable and endlessly repeating way, but the bat-like member will not tile alone. It will form rosettes of six bats, but cannot do much more without help from the lizards.

When both lizards and bats of the 60/120 set are being assembled, it is always possible to add another lizard or another bat, or to do so after a bit of rearranging of previously laid-down tiles. Achieving particular overall patterns with this set, or getting a chain of contiguous bats to extend between prescribed points, can be minor challenges.

FIG. 4 shows a patch of a tiling by the 60/120 based Lizard/Bat set.

A second basic embodiment: The 90/90 set of the Lizard/Bat family

FIG. 5 shows a two-member set using the same amphographic line, but whose ancestral rhombuses are the squares shown by the dotted lines.

Operation of the 90/90 set of the Lizard/Bat family

FIG. 6 shows a patch of such a tiling, having a square ancestral rhombus and using the same amphographic line. The tiling style is, of course, different from that of 60/120 based sets. This set also, by itself, is a fully functioning embodiment of the invention, and will form an infinite number of tilings.

A third basic embodiment: The 60/120 set of the Lizard/Pterodactyl family

Figure 7A:
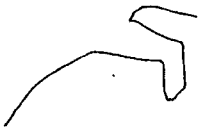
FIGS. 7A, 7B, and 7C show the amphographic line of the Lizard/Pterodactyl family, and the pterodactyl and lizard which result from it, with internal drawing.

FIG. 7A shows the amphographic line of the Lizard/Pterodactyl family.

Figure 7B:
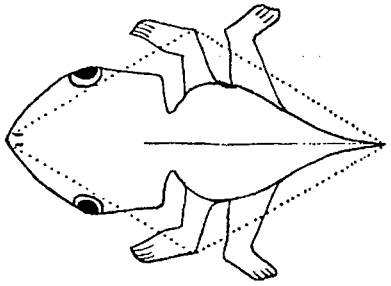
Figure 7C:
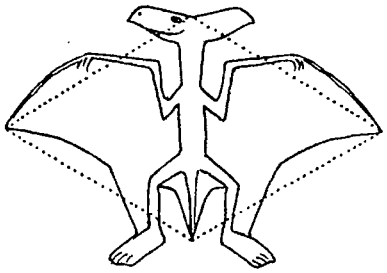

FIGS. 7B and 7C show the two-members of a set of tiles in which one tile has a lizard-like outline and the other tile has a pterodactyl-like outline. The outlines are shown with internal drawing to enhance their particular zoomorphic characters. The 60/120 ancestral rhombuses are shown by dotted lines. The amphographic line used in this embodiment is a relatively slight modification of that of the Lizard/Bat family. This set of tiles is derived in the same manner as the sets of the first and second embodiments previously described, Operation of the Lizard/Pterodactyl set The Lizard/Pterodactyl set functions to form tilings in the same way as the 60/120 Lizard/bat set of the first embodiment described above.

A fourth basic embodiment: The Arachnoid/Insectoid set

Figure 8A:
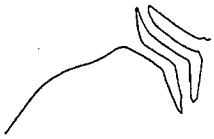
FIGS. 8A, 8B, and 8C show the Arachnoid/Insectoid amphographic line and the entire 60/120-based Arachnoid/Insectoid set and family.

FIG. 8A shows an amphographic line formative of the Arachnoid /Insectoid set.

Figure 8B:
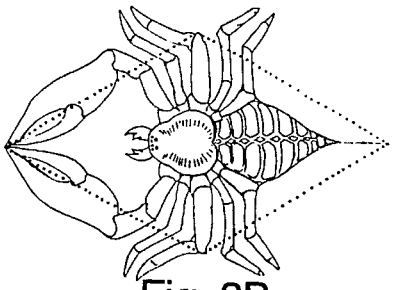
Figure 8C:
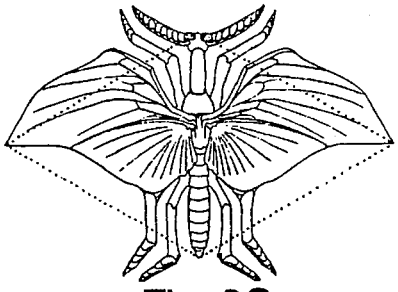

FIGS. 8B and 8C show a two-figure set of tiles. The zoomorph of FIG. 8A has an arachnid-like outline and that of FIG. 8C has an insect-like outline. They are shown with internal drawing devised to enhance the zoomorphic characters of the respective outlines. The 60/120 ancestral rhombuses are shown by dotted lines in FIGS. 8B and 8C. The relative width, or amplitude, of the curves and recurves of the Insectoid/Arachnoid-forming amphographic line, as well as a more critical quality of the drawn figures, preclude the line's use with any plane-tiling ancestral rhombus except a 60/120 rhombus. Consequently the family is limited to the one set shown.

Operation of the Arachnoid/Insectoid set

Figure 9:
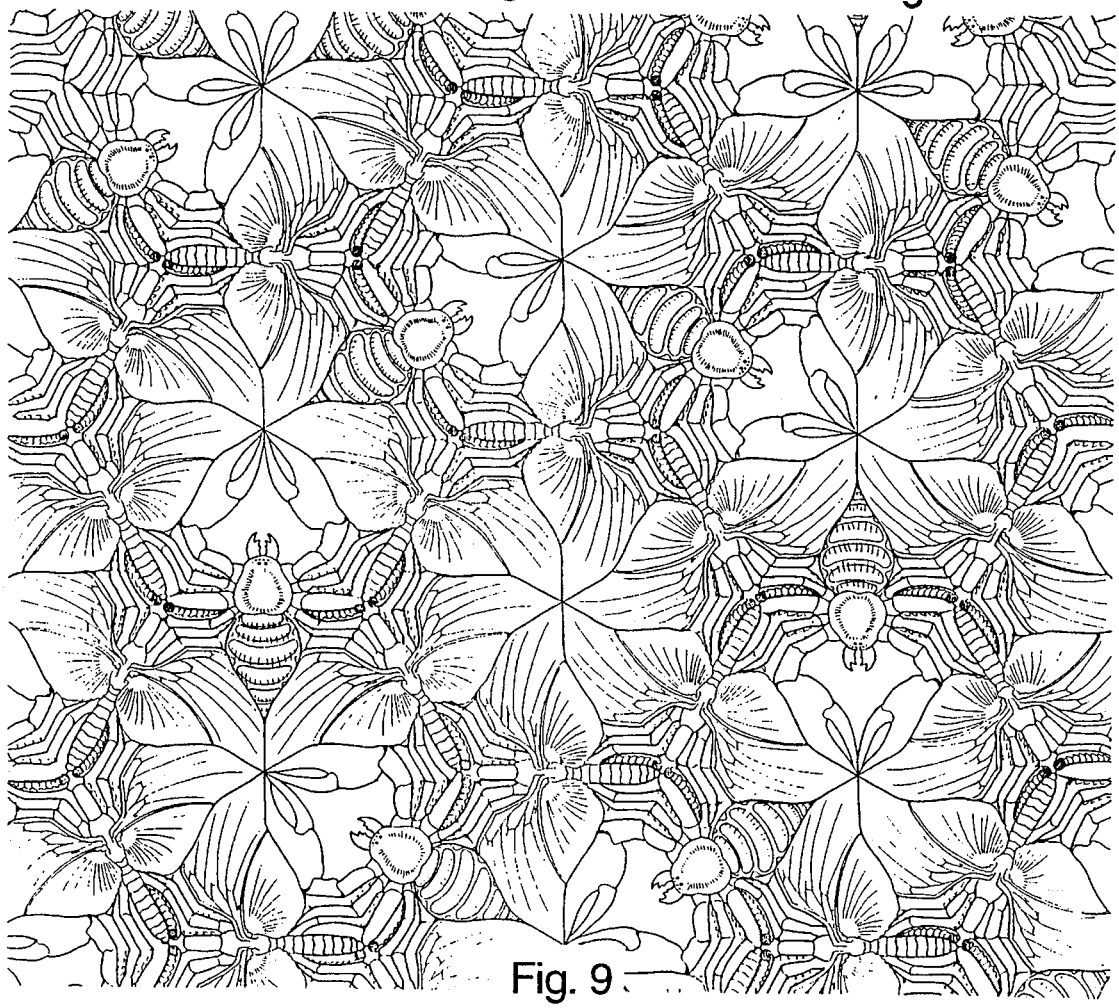
FIG. 9 shows a portion of a tiling by the Arachnoid/Insectoid set, with internal drawing.

FIG. 9 shows a portion of a tiling by the Arachnoid/insectoid set of tiles. This set of zoomorphs can tile the plane in the same ways as can the 60/120 Lizard/Bat set of FIGS. 1 and 4, and the Lizard/Pterodactyl set of FIGS. 7B and 7C.

A fifth basic embodiment: the Mother and Baby Sea Turtles

FIG. 10 shows a two-member set of figurative tiles in which one tile has the outline of an adult sea turtle and the other tile has the outline of a hatchling sea turtle. Internal drawing is used to enhance the characters of the two different outlines.

FIGS. 11A, 11B, and 11C show the derivation of a first turtle shape, using an end-labeled amphographic line, by a process exactly like that described for FIGS. 2A, 2B, and 2C. The procedure, with reference to FIG. 11C, being one of replacing the four straight sides of an ancestral rhombus with an amphographic line, the particular relative orientations and dispositions of the copies and reflections of this amphographic line being most easily and systematically achieved by rotating any line Y–Z around Z to form an adjacent side, and then reflecting the two adjacent sides thus formed, as a unit, across the rhombus to replace the remaining two straight sides, and thus, in this example, to form a zoomorphic outline resembling that of an adult turtle.

FIG. 12A, 12B, and 12C show the derivation of a second, and different, turtle shape from a relabeled initial amphographic line, as shown in FIG. 12A, by exactly the same procedure. This method of forming the second, and different, turtle outline follows exactly the same procedure as described for FIG. 11C, differing only in that it is performed after turning the initial amphographic line end-for-end.

Operation of the Sea Turtle family

FIG. 13 shows a patch of a tiling by the Mother and Baby Sea Turtles. Notice that the baby "swims" in straight lines and "turns" acute angles. This is a different style of tiling than the previously described embodiments, and it, too, can tile the plane in an infinite number of different ways.

The preferred embodiment: Five Lizards and Five Bats

FIG. 14 shows five different two-member sets of the Lizard/Bat family. These five lizards and five bats chosen for the preferred embodiment have ancestral rhombuses whose acute angles are multiples of 15 degrees, ranging from 30 degrees to 90 degrees. In this family an elongated lizard whose ancestral rhombus has acute angles of 15 degrees is not possible because the portion of the lines forming the end of the tail of the lizard interfere at angles less than 30 degrees. At the other end of the family's sequence of 15 degree increments there might be sets whose ancestral rhombuses would be "over-square". An example might be an ancestral rhombus having angles of 105/75 degrees. A set based on such a rhombus would not be identical with the 75/105 set, but would have a more long-bodied and short-winged bat member, and a lizard member more short and fat than even the respective zoomorphs of the square-based set. I include no over-square sets in the preferred embodiment, partly because of their loss of zoomorphic recognizability.

Accordingly, the preferred embodiment of my invention includes, but is not limited to, the first two basic embodiments: the 60/120 Lizard/Bat set and the 90/90 Lizard/Bat set. To further enhance the tiling capabilities as well as the aesthetic and the intellectual appeal of the preferred embodiment, I also include in the favored embodiment three more sets. These are the two-membered sets deriving from 30/150, 45/135, and 75/105 ancestral rhombuses in the manner described for FIGS. 2A, 2B, 2C, 3A, 3B, and 3C.

Operation of the Five Lizards and the Five Bats of the preferred embodiment

Figure 15:
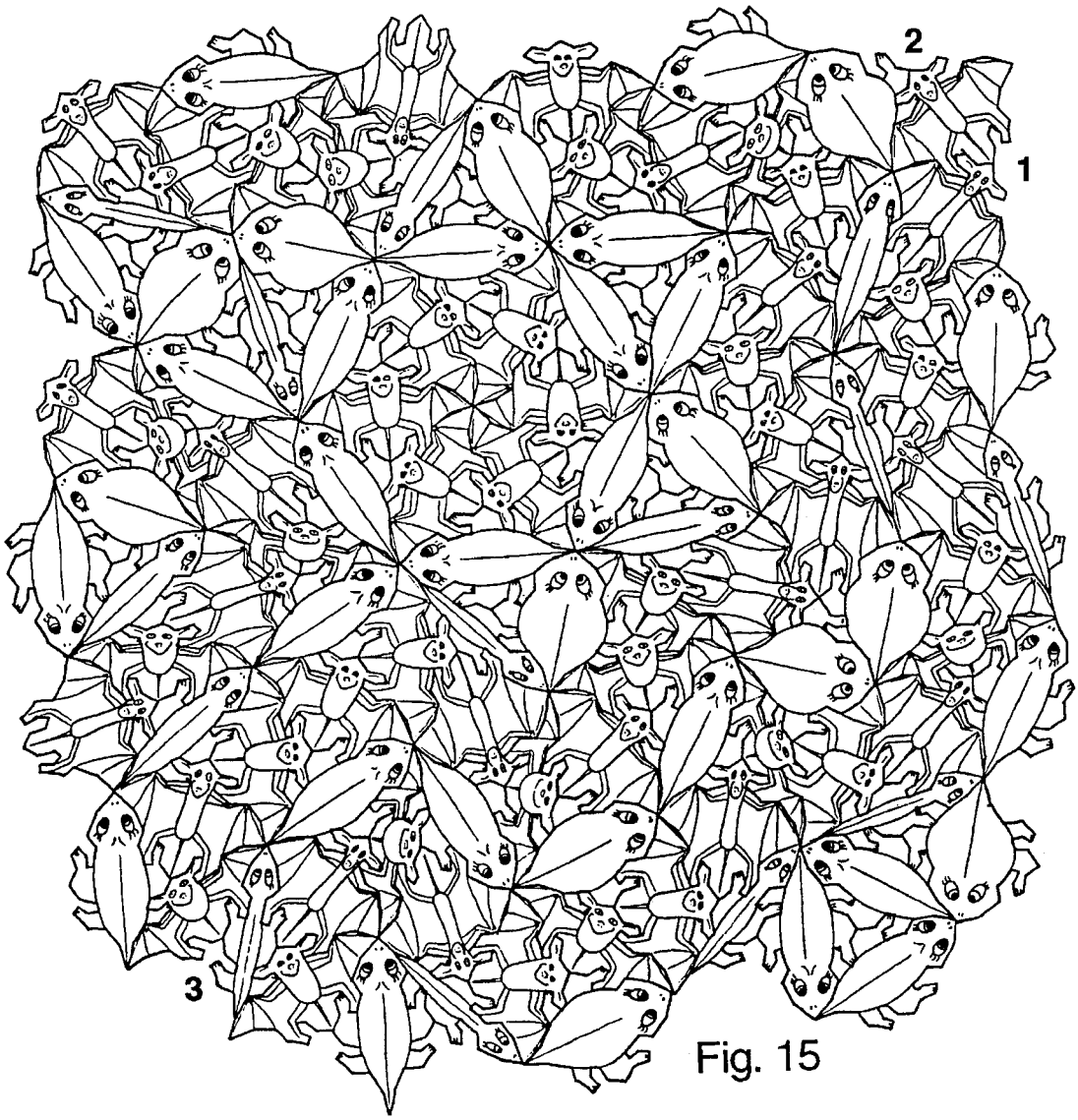
FIG. 15 shows a patch of tiles of the preferred embodiment.

FIG. 15 shows a patch of tiles of the preferred five lizards and five bats. Here, as within any family, any tile can be fitted to any of the four sides of any other tile, provided only that the tiles are matched as to size. It may or may not be possible to fit a third tile to the border formed by the conjunction of two tiles. Several tiles may meet at a vertex and leave a gap that cannot be filled by any tile. In either case, one must then dismantle and rebuild that area of the tiling in a different way.

In the process of assembling tilings with the five two-member sets of the preferred embodiment one fairly frequently finds spaces which seem to call for a lizard or a bat of the impossible 15/165 degree set, (as may be seen in the border areas marked 1 and 2 in FIG. 15), or which could be filled by a lizard or a bat derived from an over-square rhombus such as the 105/75 degree sort, (as may be seen in the border area marked 3 in FIG. 15). However, rearranging some previously laid down tiles will remedy the situation and permit the tiling to proceed with only tiles of the five sets of the embodiment preferred at present.

In contrast to the feeling of control which was remarked on in the summary and which one usually feels when assembling these tilings, there are other times when one has an almost eerie feeling that one's moves are being controlled in a way one does not understand. This occurs when a certain symmetry is being forced because of moves one has made earlier.

Some multi-member subsets of the ten zoomorphs of the preferred embodiment will also tile the plane. Five of these are shown as follows.

Figure 16:
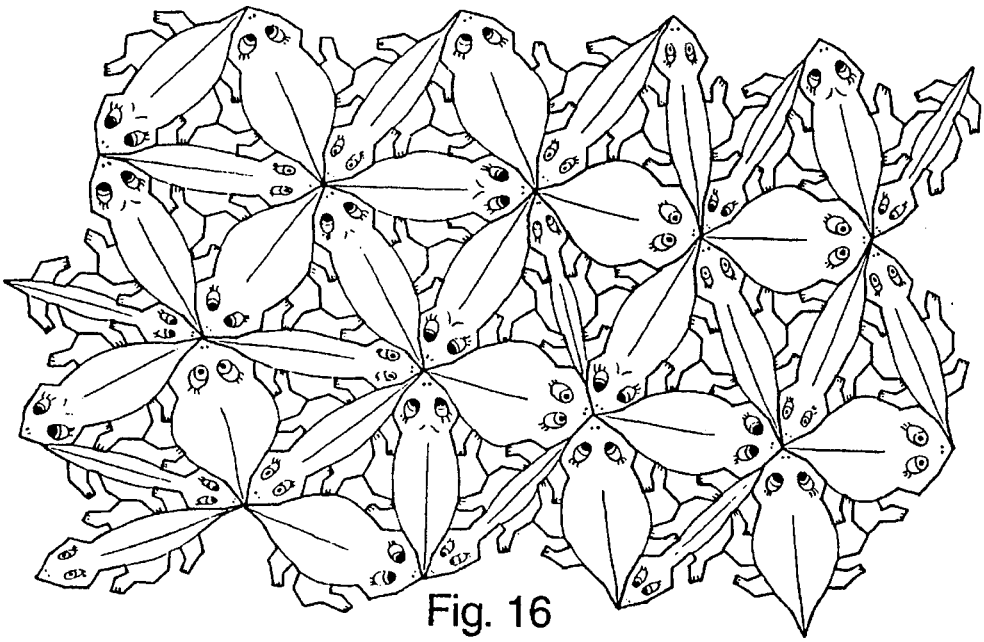
FIG. 16 shows a patch of a subset of the preferred embodiment consisting of the five lizards of the preferred embodiment.

FIG. 16 shows a patch tiled by lizards only, the lizards being of all five sorts found in the preferred embodiment.

Figure 17:
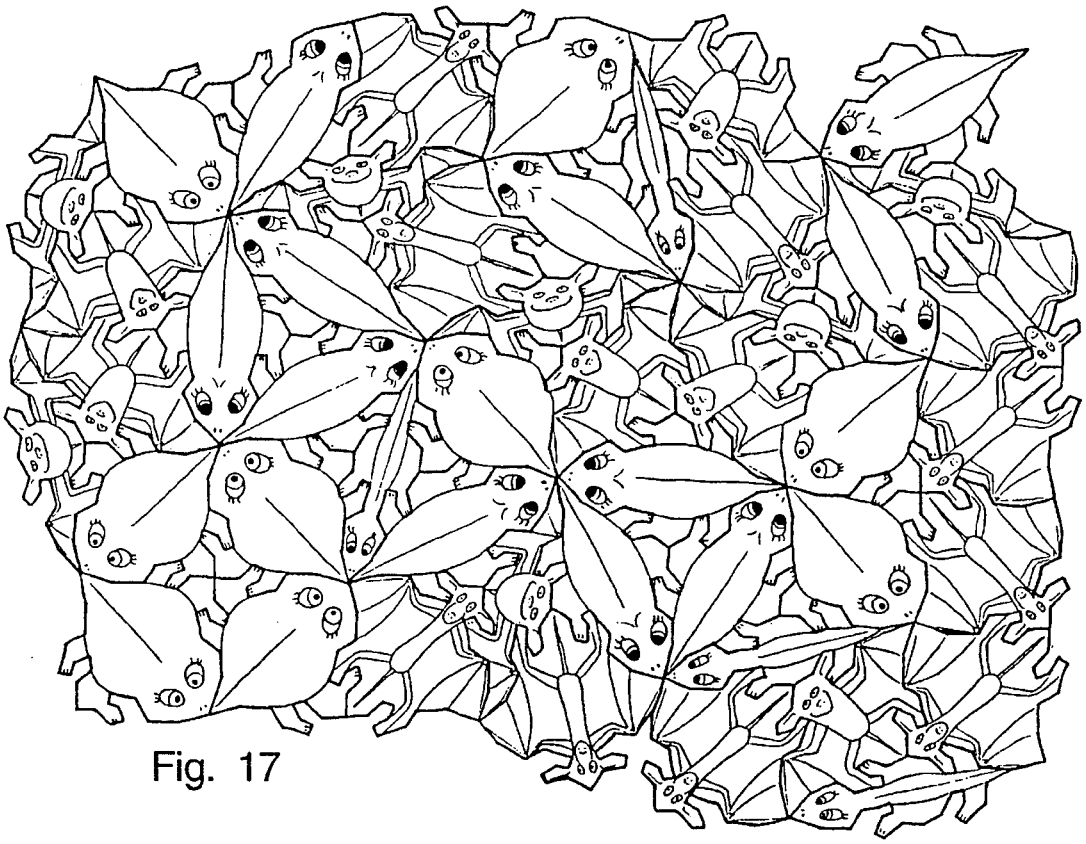
FIG. 17 shows a tiling by the 30/150, 60120, and 90/90 subsets.

FIG. 17 shows a patch tiled by the 30/150, the 60/120, and the 90/90 subsets of the preferred embodiment.

Figure 18:
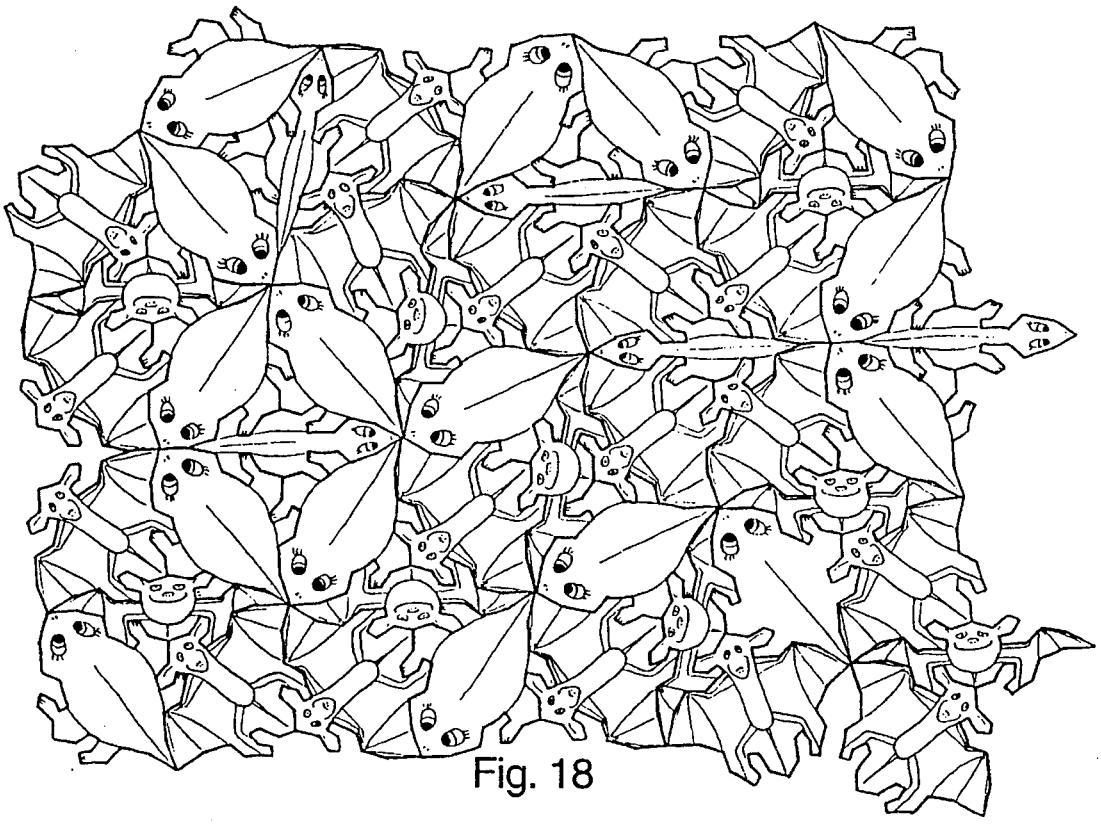
FIG. 18 shows a patch of another subset of the preferred embodiment: the 75/105, and 30/150 sets.

FIG. 18 shows a patch tiled by the 30/150 and the 75/105 subsets of the preferred embodiment. The style of tiling is likely to vary according to which subsets are being used, but a portion of a tiling which is tiled by one multi-member subset can always, so far as I know, transition to a tiling by other multi-member subsets of the preferred embodiment.

Figure 19:
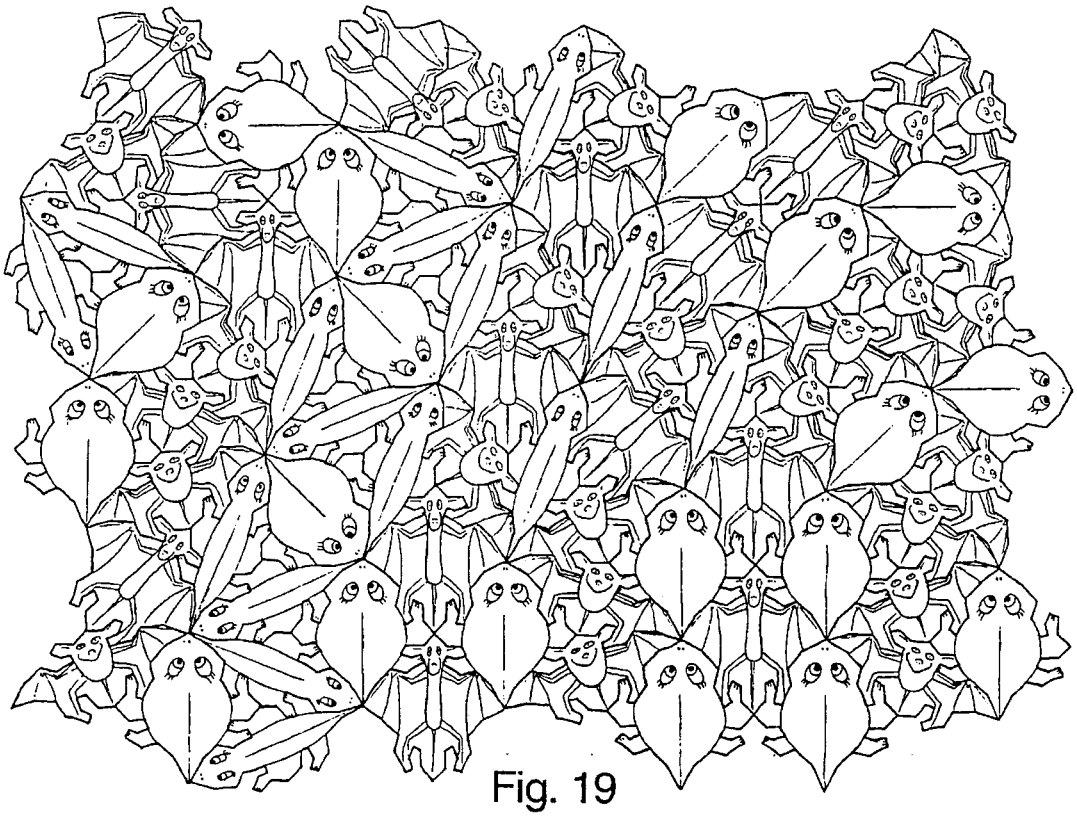
FIG. 19 shows a patch tiled by the 90/90 and the 45/135 sets of the preferred embodiment.

FIG. 19 shows a portion of a tiling by the 90/90 and the 45/135 sets.

Figure 20:
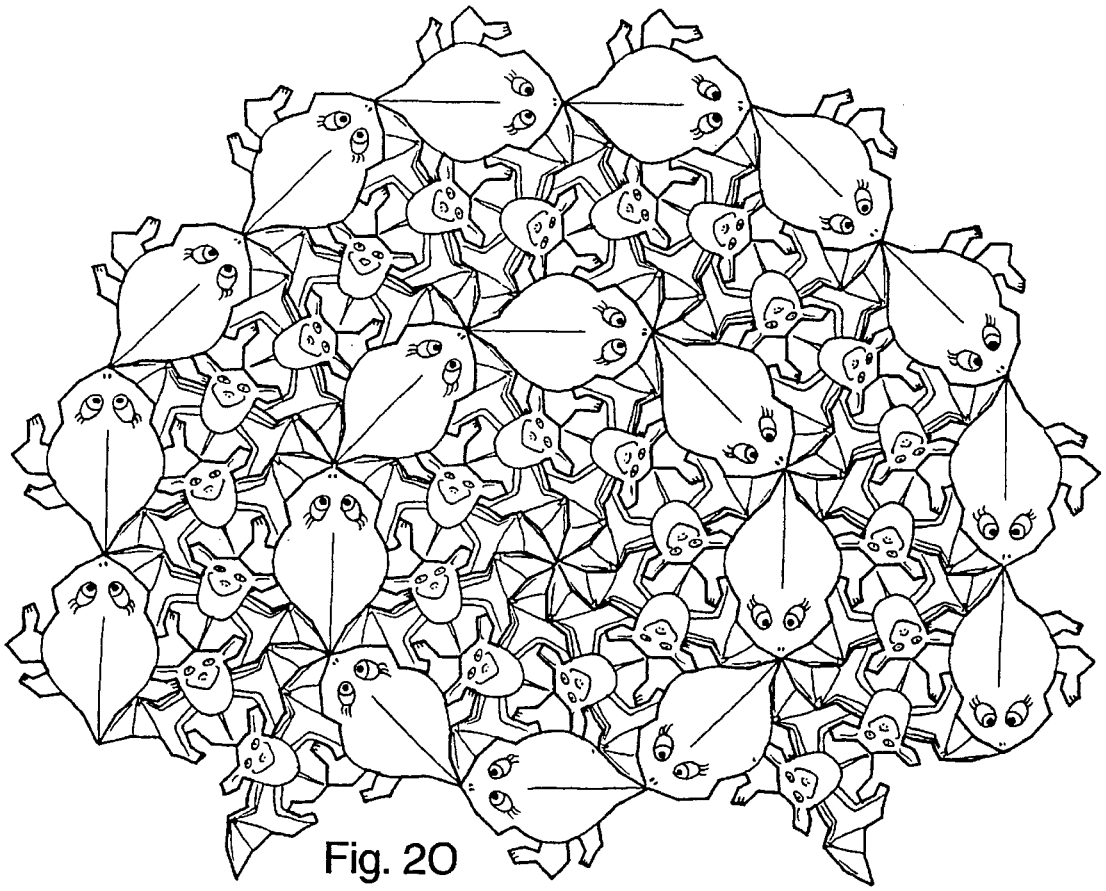
FIG. 20 shows part of a radially symmetrical tiling by the 45/135 bats and the 90/90 lizards.

FIG. 20 shows a portion of a radially symmetrical tiling by the lizard of the 90/90 set and the bat of the 45/135 set.

Not shown is an attractive radially symmetrical tiling having a central rosette of eight lizards of the 45/135 set and also including lizards of the 90/90 set.

Discussion and Theory

The simplest embodiment of a puzzle, having perhaps the fewest component parts, is often not desirable, regardless of its capabilities, simply because it is not puzzling enough. Deliberately increasing the complexity of a puzzle can enhance not only the difficulty and attractiveness of the puzzles of which it is capable, but also its aesthetic and its intellectual appeal. Thus the performance called for in a puzzle may best be achieved not by the simplest embodiment, but by a deliberately complicated one, such as is seen in the preferred embodiment of the present invention.

In regard to the choices of zoomorphs from those which may be possible from a single ancestral rhombus and a particular amphographic line, the sets usually have two members, but may have more if zoomorphs of the corresponding over-square rhombus are zoomorphically recognizable.

Recognizability and good appearance govern many choices. The axis of symmetry of a zoomorph formed as described herein may lie along either the short or the long diagonal of the ancestral rhombus. However, any zoomorph is likely to be much more recognizable and "normal" looking with its axis of symmetry nearer either one or the other extreme of longness or shortness. Thus the lizard looks best when longer than it is wide, and the bat looks best when wider than it is long. Appearance is one controlling criterion in this art. The other is ability to function in a tiling.

Regarding the several statements I have made about one or another set's ability to form infinite numbers of distinct tilings, one informal proof of this for a basic embodiment will suffice. Consider FIG. 4. The portion of the figure near the top of the page shows a straight row of bats running from left to right and crossing an area of lizards. The reader will see that the straight row of bats is potentially infinitely extensible as are the areas composed only of lizards on each side. That would constitute one unique tiling of the plane. Two such rows of bats could then distinguish a second infinitely extensive tiling, and so on for every number in the series of natural numbers. Since that series is infinite, so is the number of unique Bat/Lizard tilings, using the 60/120 set, corresponding to the members of that series.

Ramifications of the Invention and Scope of the Claims

For most families, (families being based on possession of common amphographic lines), many different combinations of two-zoomorph sets can be found which, if conjoined, will tile the plane. For instance, a two-zoomorph set, (of either Lizard/Bat or other family, and derived in the way described for FIGS. 2 and 3), can have ancestral rhombuses which have internal vertex angles of 72/108 degrees, and another set can have rhombuses of 36/144 degrees. These rhombuses' angles are multiples of 36 degrees. They match the fat and skinny rhombuses used by Penrose in one of his obligatorily non periodic tilings. (See U.S. Pat. No. 4,133,152 of Jan. 9, 1979, to Penrose.) A skinny-rhombus lizard and a fat-rhombus bat do not, however, constitute a Penrose quasiperiodically tiling set unless one half of the bat is upside-down relative to the other half, in which case any figurative or zoomorphic quality is utterly lost. Nevertheless, the four zoomorphs which can be derived from these two rhombuses in the manner of my own invention tile the plane in very interesting ways, in some of which a radial symmetry is enforced.

This combination of a 36/144 set with a 72/108 set in either the Lizard/Pterodactyl or the Lizard/Bat families, illustrates the fact that there are, in most zoomorphic families, numerous distinct geometric groupings of ancestral rhombuses, based on different fractions of 360 degrees, which can give rise to embodiments of the present invention which have not been specified in detail herein. Thus there are other geometric bases which can yield versions of a family's zoomorphs which will have quite different tiling styles. The Lizard/Pterodactyl set illustrates the fact that for any given family, (here specifically the Lizard/Bat family), a range of progressive slight modifications of the characterizing amphographic line can generate many more-or-less closely related neighboring families of the invention. Thus there can be an indefinite number of near copies or look-alike families, no others of which are described herein.

The Mother and Baby Sea Turtles set and family shows that the sets of zoomorphs derived from a basic tiling ancestral rhombus such as the 60/120 rhombus need not be restricted to two zoomorphs derived in the manner given for the Lizard/Bat set of FIGS. 1, 2, and 3. Sets which are derived differently may tile in ways interestingly different from the tiling style of, say, the 60/120 Lizard/Bat set. The Mother and Baby Sea Turtle set illustrates the fact that there are different ways of deriving the tile sets that make up a family.

Tilings by the five sets of the preferred embodiment can show gaps fillable by over-square tiles of sets not specifically described herein, but which are clearly in the domain of the invention.

I believe it follows from the above illustrative examples that although the descriptions given in this application refer to many specific embodiments and different specific methods of deriving them, these descriptions and references should not be construed as limiting the scope of the invention, but as merely providing illustrations of some of the embodiments preferred at the present time.

I claim:

1. Families of zoomorphic tiles for tiling the plane, comprising:

at least one set of zoomorphic tiles, said at least one set comprised of two members, said two members having mutually distinct zoomorphic outlines, said mutually distinct zoomorphic outlines having vertices which map onto the respective vertices of a pair of mutually congruent ancestral rhombuses, said pair of mutually congruent ancestral rhombuses being selected from a subset of rhombs that include two squares and two 60°/120° rhombuses;

a first one of said two members corresponding to a first one of said mutually congruent ancestral rhombuses, said first member including a first side comprised of an amphographic line;

said first member including a second side adjacent to said first side, said second side comprising a rotation of said amphographic line about one end of said amphographic line;

said first member including third and fourth sides comprised of a reflection of said first and second sides as an assembly, thereby defining a first zoomorphic outline;

a second one of said two members corresponding to a second one of said mutually congruent ancestral rhombuses, said second member including a first side comprised of said amphographic line;

said second member including a second side adjacent to said first side, said second side comprising a rotation of said amphographic line about the other end of said amphographic line;

said second member including third and fourth sides comprised of a reflection of said first and second sides as an assembly, thereby defining a second zoomorphic outline;

a plurality of first and second members being capable of assembly into tilings displaying an infinite range of periodicities and into tilings displaying no periodicity.

2. The families of zoomorphic tiles of claim 1, wherein said at least one set of zoomorphic tiles includes a plurality of sets, said plurality of sets each including first and second members mapping onto an ancestral rhombus selected from a subset of rhombuses having included angles equal to 360° divided by whole numbers, whereby said plurality of sets may be assembled into tilings displaying variable periodicities and into tilings displaying no periodicity.

3. The families of zoomorphic tiles of claim 2, wherein said plurality of sets includes:

a first set of tiles having two members that are mutually distinct zoomorphs whose vertices map onto vertices of 36°/144° ancestral rhombuses;

a second set of tiles having two members that are mutually distinct zoomorphs whose vertices map onto vertices of 72°/108° ancestral rhombuses;

said members of said first and second sets of tiles enabling a multiplicity of tilings having five-told symmetry.

4. Families of zoomorphic tiles for tiling the plane, comprising:

at least one set of zoomorphic tiles, said at least one set comprised of two members, said two members having mutually distinct zoomorphic outlines, said mutually distinct zoomorphic outlines having vertices which map onto a pair of mutually congruent ancestral rhombuses, said pair of mutually congruent ancestral rhombuses being selected from a subset of rhombs that include two squares and two 60°/120° rhombuses;

a first one of said two members corresponding to a first one of said mutually congruent ancestral rhombuses, said first member including a first side comprised of an amphographic line;

said first member including a second side adjacent to said first side, said second side comprising a rotation of said amphographic line about a first vertex common to said first and second sides;

said first member including third and fourth sides comprised of a reflection of said first and second sides as an assembly, thereby defining a first zoomorphic outline;

a second one of said two members corresponding to a second one of said mutually congruent ancestral rhombuses, said second member including a first side corresponding in location to said first side of said first member, said first side of said second member comprised of said amphographic line rotated in the plane 180° end for end;

said second member including a second side adjacent to said first side, said second side comprising a rotation of said first side about a second vertex corresponding geometrically to said first vertex of said first member;

said second member including third and fourth sides comprised of a reflection of said first and second sides as an assembly, thereby defining a second zoomorphic outline;

a plurality of said first and second members being capable of assembly into tilings displaying variable periodicity and into tilings displaying no periodicity.

5. The family of zoomorphic tiles of claim 4, wherein said at least one set of zoomorphic tiles includes a plurality of sets, said plurality of sets each including first and second members mapping onto an ancestral rhombus selected from a subset of rhombuses having included angles equal to 360° divided by whole numbers, whereby said plurality of sets may be assembled into tilings displaying variable periodicities and into tilings displaying no periodicity.

6. The family of zoomorphic tiles of claim 5, wherein said plurality of sets includes:

a first set of tiles having two members that are mutually distinct zoomorphs whose vertices map onto vertices of 36°/144° ancestral thombuses;

a second set of tiles having two members that are mutually distinct zoomorphs whose vertices map onto vertices of 72° /108° ancestral rhombuses;

said members of said first and second sets of tiles being variably combinable in a multiplicity of tilings having five-fold symmetry.

* * * * *